US008681086B2

(12) United States Patent
Peng et al.

(10) Patent No.: US 8,681,086 B2
(45) Date of Patent: Mar. 25, 2014

(54) DATA DRIVER AND MULTIPLEXER CIRCUIT WITH BODY VOLTAGE SWITCHING CIRCUIT

(71) Applicant: Novatek Microelectronics Corp., Hsinchu (TW)

(72) Inventors: Yu-Hsun Peng, Hsinchu County (TW); Hsi-Chi Ho, Hsinchu (TW); Li-Chun Huang, Hsinchu (TW)

(73) Assignee: Novatek Microelectronics Corp, Hsinchu (TW)

( * ) Notice: Subject to any disclaimer, the term of this patent is extended or adjusted under 35 U.S.C. 154(b) by 0 days.

(21) Appl. No.: 13/722,326

(22) Filed: Dec. 20, 2012

(65) Prior Publication Data

US 2013/0120352 A1 May 16, 2013

Related U.S. Application Data

(62) Division of application No. 12/232,344, filed on Sep. 16, 2008, now abandoned, which is a division of application No. 13/303,972, filed on Nov. 23, 2011.

(30) Foreign Application Priority Data

Jun. 26, 2008 (TW) ..... 97123913 A

(51) Int. Cl.
*G09G 3/36* (2006.01)

(52) U.S. Cl.
USPC ..... 345/100

(58) Field of Classification Search
USPC ..... 345/211, 212, 98, 100
See application file for complete search history.

(56) References Cited

U.S. PATENT DOCUMENTS 5,608,344 A * 3/1997 Marlow ..... 327/206
6,008,801 A 12/1999 Jeong
6,242,962 B1 6/2001 Nakamura
7,106,295 B2 9/2006 Watanabe et al.

(Continued)

FOREIGN PATENT DOCUMENTS

JP 09-179095 A 7/1997
JP 10-240204 A 9/1998

(Continued)

OTHER PUBLICATIONS

Maxim Integrated. "What is a Transmission Gate (Analog Switch)?" Tutorial 4243. Jun. 10, 2008.*
Office Action Issued by Japan Patent Office dated Jul. 25, 2013 with English Translation.

*Primary Examiner* — Allison W Johnson
(74) *Attorney, Agent, or Firm* — Rabin & Berdo, P.C.

(57) ABSTRACT

A data driver includes two data processing circuits for respectively providing positive and negative pixel voltages according to first and second pixel data, and a multiplexer circuit including multiplexer units. Each multiplexer unit has first and second input terminals respectively receiving the positive and negative pixel voltages, and an output terminal coupled to a data line. A first switching device has first and second switches serially coupled between the first input and output terminals. A node between the first and second switches is selectively grounded via a third switch. A second switching device has fourth and fifth switches serially coupled between the second input and output terminals. A node between the fourth and fifth switches is selectively grounded via a sixth switch. When the first and second switches turn on, the sixth switch turns on. When the fourth and fifth switches turn on, the third switch turns on.

22 Claims, 6 Drawing Sheets

140

(56) References Cited

U.S. PATENT DOCUMENTS

| | | | | |
|---|---|---|---|---|
| 7,812,804 | B2 * | 10/2010 | Hashimoto | 345/98 |
| 8,072,404 | B2 | 12/2011 | Watanabe et al. | |
| 2004/0125067 | A1 * | 7/2004 | Kim et al. | 345/98 |
| 2006/0232539 | A1 * | 10/2006 | Hashimoto | 345/96 |
| 2008/0089003 | A1 | 4/2008 | Kojima et al. | |
| 2008/0186216 | A1 | 8/2008 | Choi | |
| 2009/0015574 | A1 | 1/2009 | Kim et al. | |
| 2009/0135121 | A1 | 5/2009 | Chiang et al. | |

FOREIGN PATENT DOCUMENTS

| | | | |
|---|---|---|---|
| JP | 2000010075 | A | 1/2000 |
| JP | 2002204153 | A | 7/2002 |
| JP | 2003-058132 | A | 2/2003 |
| JP | 2003-270660 | A | 9/2003 |
| JP | 2005-321776 | A | 11/2005 |
| JP | 2006-310989 | A | 11/2006 |
| JP | 2007-079173 | A | 3/2007 |
| JP | 2008-102211 | A | 5/2008 |

* cited by examiner

DATA DRIVER AND MULTIPLEXER CIRCUIT WITH BODY VOLTAGE SWITCHING CIRCUIT

This application is a divisional application of co-pending U.S. application Ser. No. 13/303,972, filed Nov. 23, 2011, which is a divisional application of co-pending U.S. application Ser. No. 12/232,344, filed Sep. 16, 2008, which claims the benefit of Taiwan application Serial No. 97123913, filed Jun. 26, 2008. The contents of these applications are incorporated herein by reference.

BACKGROUND OF THE INVENTION

1. Field of the Invention

The invention relates in general to a driver, and more particularly to a data driver.

2. Description of the Related Art

In order to prevent the physical properties of the liquid crystal molecules from being damaged in the method of driving a liquid crystal display, voltages with different polarities have to be alternately applied to drive the liquid crystal molecules. In the driving method using the fixed common voltage, a data driver properly drives the liquid crystal molecules by converting the polarities of the voltages outputted therefrom.

Conventionally, when the data driver is driving the liquid crystal molecules, the levels of the driving voltages range from about −6 volts to 6 volts. At this time, the maximum crossover voltage to be withstood by circuit elements used in the data driver may be equal to 12 volts (−6 to 6 volts). In order to withstand the crossover voltage of 12 volts during the process of driving the liquid crystal display, the circuit elements capable of withstanding high voltages have to be used in the data driver. However, the data driver using the circuit elements capable of withstanding the high voltages disadvantageously has the too-large size and the high cost. Therefore, it is an important subject in the industry to reduce the size and the cost of the data driver.

SUMMARY OF THE INVENTION

The invention is directed to a data driver, in which the number of used circuit elements capable of withstanding high voltages is decreased, and the size of the data driver, the chip area and the cost can be reduced without increasing the power consumption of the system.

According to a first aspect of the present invention, a data driver is provided. The data driver is for correspondingly driving a plurality of data lines of a display panel according to a plurality of pixel data. The pixel data include a first pixel datum and a second pixel datum. The data driver includes a first data processing circuit, a second data processing circuit and a multiplexer circuit. The first data processing circuit and the second data processing circuit process the pixel data. The first data processing circuit provides a positive pixel voltage according to the first pixel datum. The second data processing circuit provides a negative pixel voltage according to the second pixel datum. The multiplexer circuit includes a plurality of multiplexer units. Each of the multiplexer units includes a first input terminal, a second input terminal, an output terminal, a first switching device and a second switching device. The first input terminal and the second input terminal respectively receive the positive pixel voltage and the negative pixel voltage. The output terminal is coupled to one of the data lines. The first switching device has a first switch, a second switch and a third switch. The first and second switches are serially coupled between the first input terminal and the output terminal. A first node between the first and second switches is selectively grounded via the third switch. The second switching device has a fourth switch, a fifth switch and a sixth switch. The fourth and fifth switches are serially coupled between the second input terminal and the output terminal. A second node between the fourth and fifth switches is selectively grounded via the sixth switch. The sixth switch turns on when the first and second switches turn on, and the third switch turns on when the fourth and fifth switches turn on.

According to a second aspect of the present invention, a data driver is provided. The data driver is for correspondingly driving a plurality of data lines of a display panel according to a plurality of pixel data. The pixel data include a first pixel datum and a second pixel datum. The data driver includes a first data processing circuit, a second data processing circuit and a multiplexer circuit. The first data processing circuit provides a positive pixel voltage according to the first pixel datum. The second data processing circuit includes a level shifter, a digital-to-analog converter and an output buffer. The level shifter receives the second pixel datum having a voltage level ranging between a ground level and a first positive level, adjusts the voltage level of the second pixel datum to a level ranging between a first negative level and the first positive level, then adjusts the voltage level of the second pixel datum to a level ranging between the first negative level and the ground level, and then adjusts the voltage level of the second pixel datum to a level ranging between a second negative level and the ground level. The digital-to-analog converter converts the second pixel datum, outputted from the level shifter, into a negative pixel voltage. The output buffer temporarily stores the negative pixel voltage. The multiplexer circuit outputs the positive pixel voltage and the negative pixel voltage to two of the data lines. An absolute value of the first negative level is smaller than an absolute value of the second negative level.

According to a third aspect of the present invention, a data driver is provided. The data driver is for correspondingly driving a plurality of data lines of a display panel according to a plurality of pixel data. The pixel data include a plurality of first pixel data and a plurality of second pixel data. The data driver includes a first data processing circuit, a second data processing circuit and a multiplexer circuit. The first data processing circuit provides a plurality of positive pixel voltages according to the first pixel data. The second data processing circuit includes a front-stage level shifter, a shift register, a line buffer, a post-stage level shifter, a digital-to-analog converter and an output buffer. The front-stage level shifter sequentially receives the second pixel data having corresponding voltage levels ranging between a ground level and a first positive level, and adjusts the voltage levels of the second pixel data to voltage levels ranging between a first negative level and the ground level. The shift register sequentially receives the second pixel data, outputted from the front-stage level shifter, and outputs the second pixel data in parallel. The line buffer temporarily stores the second pixel data outputted from the shift register. The post-stage level shifter adjusts the voltage levels of the second pixel data, outputted from the line buffer, to voltage levels ranging between a second negative level and the ground level. The digital-to-analog converter converts the second pixel data, outputted from the post-stage level shifter, into a plurality of negative pixel voltages. The output buffer temporarily stores the negative pixel voltages. The multiplexer circuit outputs the positive pixel voltages and the negative pixel voltages to the corresponding data lines. An absolute value of the first negative level is smaller than an absolute value of the second negative level.

The invention will become apparent from the following detailed description of the preferred but non-limiting embodiments. The following description is made with reference to the accompanying drawings.

DETAILED DESCRIPTION OF THE INVENTION

Figure 1:
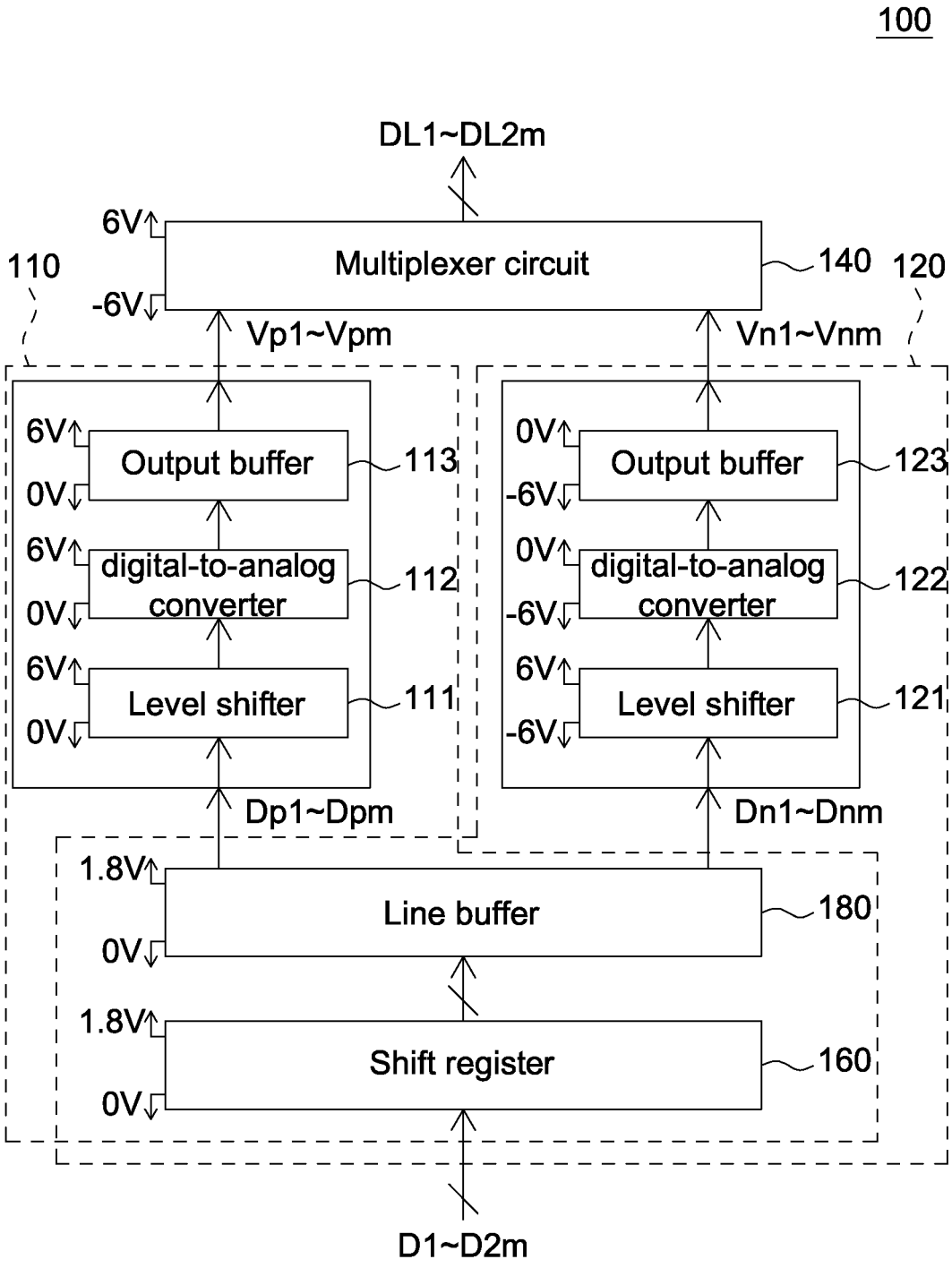
FIG. 1 is a block diagram showing a data driver.

FIG. 1 is a block diagram showing a data driver 100. Referring to FIG. 1, the data driver 100 correspondingly drives a number of data lines DL1 to DL2*m* of a display panel according to a number of pixel data D1 to D2*m*. The pixel data D1 to D2*m* include first pixel data Dp1 to Dpm and second pixel data Dn1 to Dnm. The data driver 100 includes a first data processing circuit 110, a second data processing circuit 120 and a multiplexer circuit 140. The first and second data processing circuits 110 and 120 process the pixel data D1 to D2*m*. The first data processing circuit 110 includes a level shifter 111, a digital-to-analog converter 112 and an output buffer 113. The second data processing circuit 120 includes a level shifter 121, a digital-to-analog converter 122 and an output buffer 123. The first and second data processing circuits 110 and 120 share a shift register 160 and a line buffer 180.

The shift register 160 sequentially receives the pixel data D1 to D2*m*, and outputs the pixel data D1 to D2*m* in parallel. The line buffer 180 receives the pixel data D1 to D2*m* outputted from the shift register 160, and respectively outputs the first pixel data Dp1 to Dpm (positive pixel data) and the second pixel data Dn1 to Dnm (negative pixel data) to the level shifters 111 and 121.

The digital-to-analog converters 112 and 122 respectively convert the first and second pixel data Dp1 to Dpm and Dn1 to Dnm, which are outputted from the level shifters 111 and 121, into positive pixel voltages Vp1 to Vpm and negative pixel voltages Vn1 to Vnm. The output buffers 113 and 123 temporarily store the positive pixel voltages Vp1 to Vpm and the negative pixel voltages Vn1 to Vnm. The multiplexer circuit 140 drives the data lines DL1 to DL2*m* according to the positive pixel voltages Vp1 to Vpm and the negative pixel voltages Vn1 to Vnm. Herein, each element included in the first data processing circuit 110 and the second data processing circuit 120 only pertains to one of many examples, and does not intend to limit the invention. Any data processing circuit still falls within the scope of the invention as long as it can convert the first pixel data Dp1 to Dpm and the second pixel data Dn1 to Dnm into the positive pixel voltages Vp1 to Vpm and the negative pixel voltages Vn1 to Vnm, respectively. In the following embodiments, the first pixel datum Dp represents one of the first pixel data Dp1 to Dpm, and the second pixel datum Dn represents one of the second pixel data Dn1 to Dnm.

In the embodiment of the invention, the circuit element capable of withstanding the high voltage may be defined as the circuit element implemented by the process of 2.5 microns, and the circuit element can withstand the voltage smaller than 32 volts, for example. The circuit element capable of withstanding the medium voltage may be defined as the circuit element implemented by the process of 0.6 microns, and the circuit element can withstand the voltage lower than 6 volts. In designing the data driver 100, the applicant(s) has/have found that the circuit element capable of withstanding the high voltage has to be used because the highest level of the voltage that has to be withstood by the multiplexer circuit 140 and the level shifter 121 of FIG. 1 is equal to 12 volts (−6 to 6 volts).

In one embodiment of the invention, the architecture of the multiplexer circuit 140 is improved to decrease the number of the used circuit elements capable of withstanding the high voltages. Furthermore, in another embodiment of the invention, the architecture of the level shifter 121 is improved to decrease the number of the used circuit elements capable of withstanding the high voltages. Thus, the number of the used circuit elements capable of withstanding the high voltages can be decreased in the data driver of the invention. In addition, the size of the data driver, the chip area and the cost can be reduced without increasing the power consumption of the system. The data drivers according to several embodiments of the invention will be described in the following.

First Embodiment

In this embodiment, the architecture of the multiplexer circuit 140 is improved in order to decrease the number of the used circuit elements capable of withstanding the high voltages. The multiplexer unit of this embodiment will be described in the following.

Figure 2A:
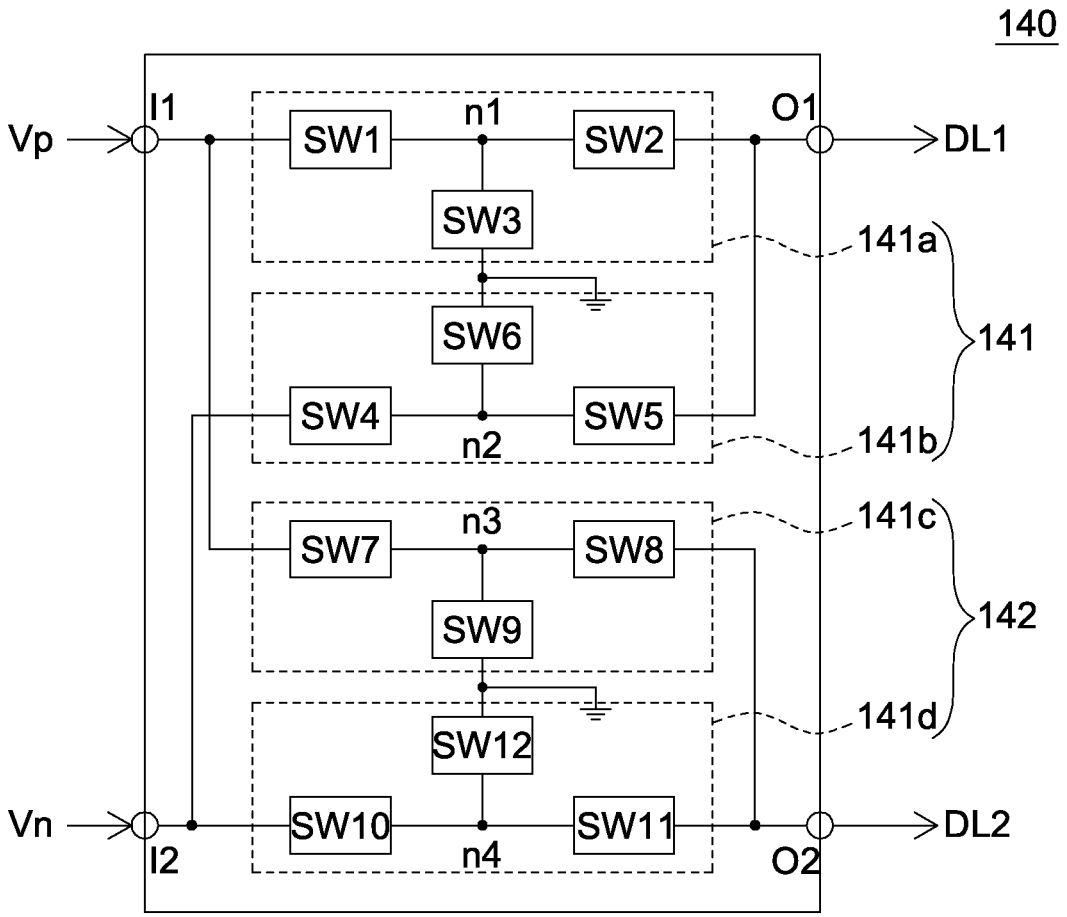
FIG. 2A is a schematic illustration showing two multiplexer units 141 and 142 of a multiplexer circuit 140 according to a first embodiment of the invention.

The multiplexer circuit 140 includes m multiplexer units. FIG. 2A is a schematic illustration showing two multiplexer units 141 and 142 of the multiplexer circuit 140 according to a first embodiment of the invention. Referring to FIG. 2A, the multiplexer unit 141 includes a first input terminal I1, a second input terminal I2, an output terminal O1, a first switching device 141*a* and a second switching device 141*b*. The first input terminal I1 and the second input terminal I2 respectively receive a positive pixel voltage Vp and a negative pixel voltage Vn. The output terminal O1 is coupled to one of the data lines DL1 to DL2*m*, such as the data line DL1.

The first switching device 141 a has a switch SW1, a switch SW2 and a switch SW3. The switches SW1 and SW2 are serially coupled between the first input terminal I1 and the output terminal O1, and a node n1 between the switches SW1 and SW2 is selectively grounded via the switch SW3. The second switching device 141*b* has a switch SW4, a switch SW5 and a switch SW6. The switches SW4 and SW5 are serially coupled between the second input terminal I2 and the output terminal O1, and a node n2 between the switches SW4 and SW5 is selectively grounded via the switch SW6.

When the switches SW1 and SW2 turn on, the switch SW6 turns on so that the node n2 between the switches SW4 and SW5 is grounded via the switch SW6 and the maximum crossover voltage of the switch SW4 and the maximum crossover voltage of the switch SW5 are equal to one half of the maximum voltage difference between the second input terminal I2 and the output terminal O1. When the switches SW4 and SW5 turn on, the switch SW3 turns on so that the node n1 between the switches SW1 and SW2 is grounded via the switch SW3 and the maximum crossover voltages of the switches SW1 and SW2 are equal to one half of the maximum voltage difference between the first input terminal I1 and the output terminal O1.

The operations of the multiplexer unit of this embodiment and the conventional multiplexer unit will be compared with each other in the following. It is assumed that the level of the positive pixel voltage Vp ranges between 0 volts and 6 volts, and the level of the negative pixel voltage Vn ranges between −6 volts and 0 volts.

Figure 2B:
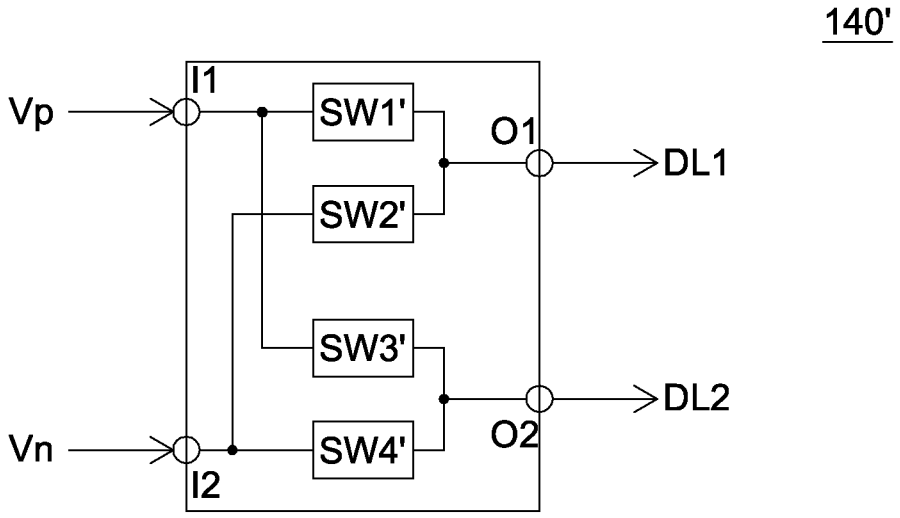
FIG. 2B(PRIOR ART)
FIG. 2B (Prior Art) is a schematic illustration showing two multiplexer units of a conventional multiplexer circuit.

FIG. 2B (Prior Art) is a schematic illustration showing two multiplexer units of a conventional multiplexer circuit 140'. As shown in FIG. 2B, the output terminal O1 outputs the positive pixel voltage Vp when the switch SW1' turns on and the switch SW2' does not turn on in the conventional multiplexer circuit 140'. At this time, the crossover voltage between two terminals of the switch SW2' is equal to the voltage difference between the negative pixel voltage Vn (−6 to 0 volts) of the input terminal I2 and the positive pixel voltage Vp (0 to 6 volts) of the output terminal O1. The voltage difference has a maximum equal to 12 volts. Thus, the switch SW2' used at this time must be the switch capable of withstanding 12 volts. Similarly, when the output terminal O1 outputs the negative pixel voltage Vn, the switch SW1' also withstands the crossover voltage having the maximum of 12 volts. Thus, the switches SW1' and SW2' are implemented by the circuit elements capable of withstanding high voltages in the conventional multiplexer circuit 140'.

As shown in FIG. 2A, however, the output terminal O1 in the multiplexer circuit 140 of this embodiment outputs the positive pixel voltage Vp when the switches SW1 and SW2 turn on and the switches SW4 and SW5 do not turn on. At this time, the switch SW6 turns on so that the node n2 is grounded. At this time, the maximum crossover voltages of the switches SW4 and SW5 are equal to one half of the maximum voltage difference between the second input terminal I2 and the output terminal O1, that is, one half of the maximum voltage difference (12 volts) between the positive pixel voltage Vp (0 to 6 volts) and the negative pixel voltage Vn (−6 to 0 volts). At this time, the maximum crossover voltage of each of the switches SW4 and SW5 is equal to 6 volts. Similarly, when the switches SW1 and SW2 do not turn on and the switches SW4 and SW5 turn on, the output terminal O1 outputs the negative pixel voltage Vn. At this time, the switch SW3 turns on so that the maximum crossover voltages of the switches SW1 and SW2 are equal to 6 volts. Thus, the switches SW1, SW2, SW3 and SW4 may be implemented by the circuit elements capable of withstanding medium voltages.

Because the size of the circuit element relates to the aspect ratio (L/W), it is concluded that the size of one circuit element capable of withstanding the high voltage is larger than sixteen times of the size of the circuit element capable of withstanding the medium voltage. Consequently, the two switches SW1 and SW2 capable of withstanding the medium voltages in the multiplexer unit 141 are used to replace one switch SW1' capable of withstanding the high voltage in the conventional multiplexer unit 141', and the switch SW3 provides the grounded voltage. The total area of the switches SW1, SW2 and SW3 is still smaller than the area of the switch SW1' as a whole. Therefore, the multiplexer circuit of this embodiment does not need the circuit element capable of withstanding the high voltage, so the size of the data driver using the multiplexer unit can be reduced.

In FIG. 2A, the architecture of the multiplexer unit 142 is similar to that of the multiplexer unit 141, so detailed descriptions thereof will be omitted. The first and second input terminals of the multiplexer unit 142 are respectively coupled to the first and second input terminals I1 and I2 of the multiplexer unit 141, as shown in FIG. 2A. The operations between the multiplexer units 141 and 142 will be described in the following. When the output terminal O1 outputs the positive pixel voltage Vp, the output terminal O2 outputs the negative pixel voltage Vn. When the output terminal O1 outputs the negative pixel voltage Vn, the output terminal O2 outputs the positive pixel voltage Vp.

Figure 3:
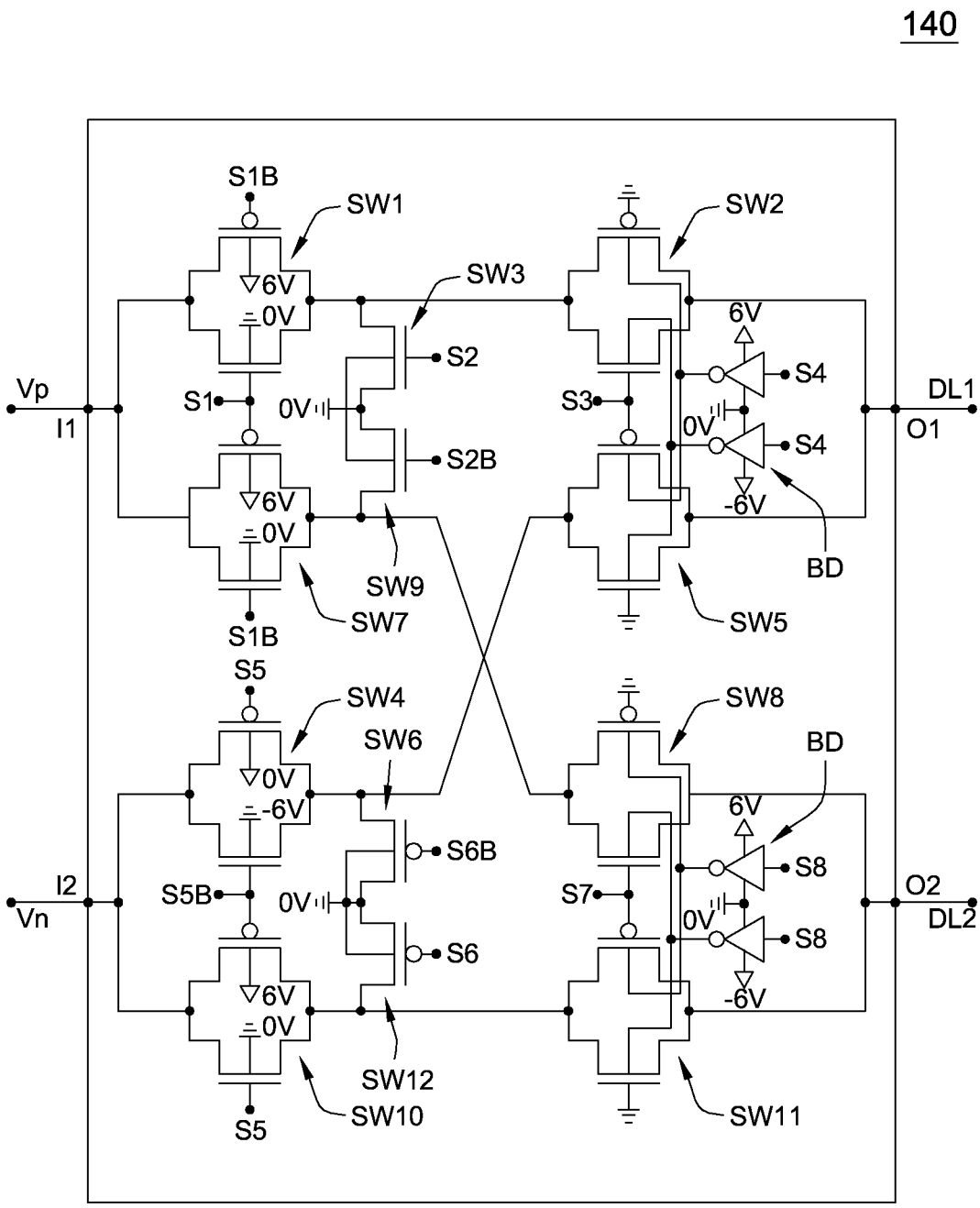
FIG. 3 is a circuit diagram showing an example of the multiplexer units 141 and 142 of FIG. 2A.
Figure 4:
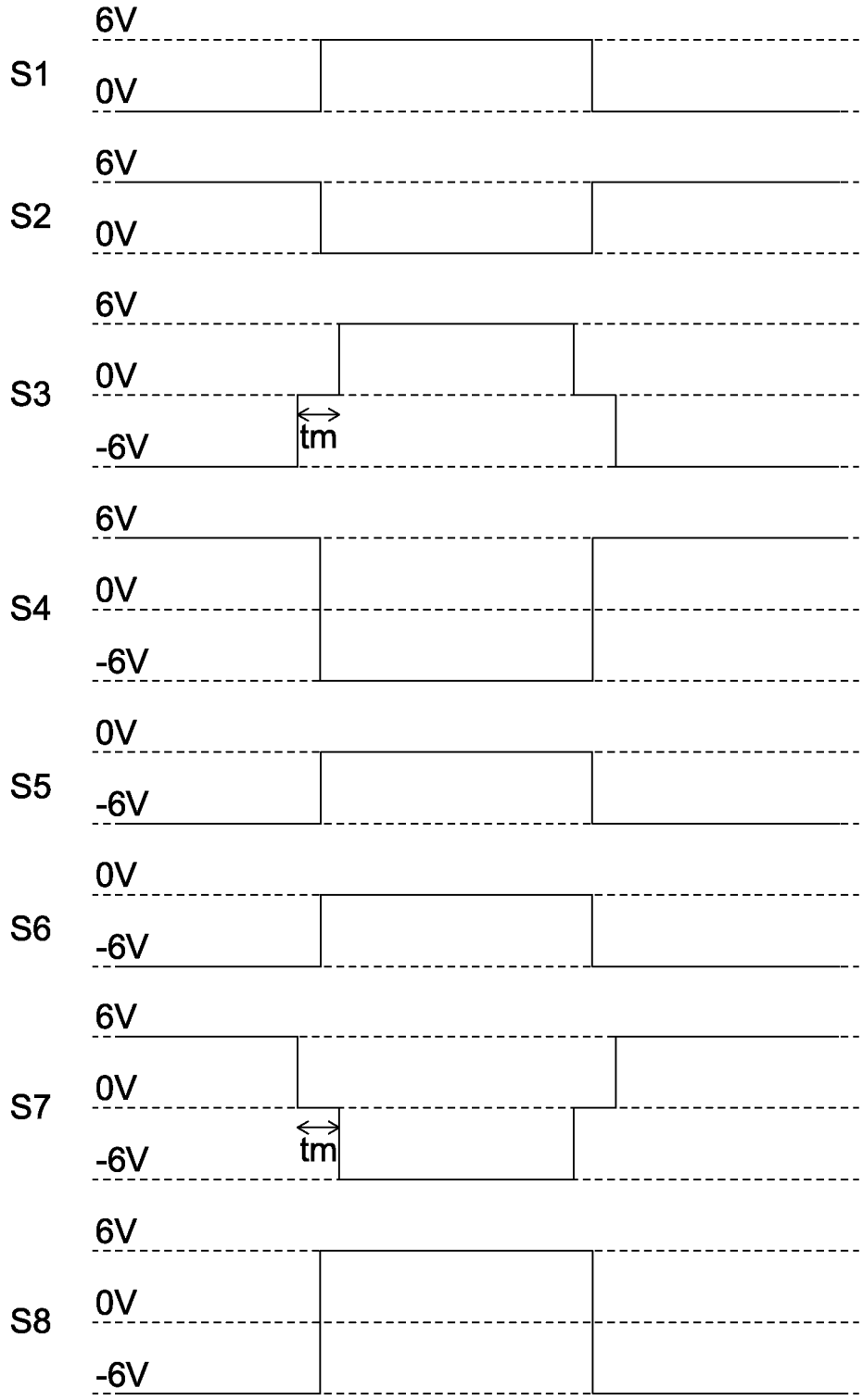
FIG. 4 shows an example of waveforms of switching signals used in the multiplexer units of FIG. 3.

FIG. 3 is a circuit diagram showing an example of the multiplexer units 141 and 142 of FIG. 2A. In this example, each of the switches SW1, SW2, SW4 and SW5 is a transmission gate (TG) and is implemented by a transistor capable of withstanding the medium voltage. Furthermore, each of the switches SW7, SW8, SW10 and SW11 may also be a transmission gate implemented by a transistor capable of withstanding the medium voltage. Each transmission gate includes a P-type metal-oxide semiconductor (PMOS) transistor and an N-type metal-oxide semiconductor (NMOS) transistor. The switches SW3 and SW6 are transistors. Furthermore, the switches SW9 and SW12 may also be implemented by transistors. FIG. 4 shows an example of waveforms of switching signals used in the multiplexer units of FIG. 3. In this example, the switching signals include a number of control signals S1 to S8, wherein the control signals S1B to S8B are inverse signals of the control signals S1 to S8, respectively.

In addition, the multiplexer circuit 140 further includes a body voltage switching circuit BD for providing a negative body voltage to each NMOS transistor and providing a positive body voltage to each PMOS transistor according to the switching signal. Thus, in the time interval tm of FIG. 4, the control signals S3 and S7 are preferably converted into the ground voltages. Thus, it is possible to prevent a forward body bias from being generated when the transmission gate turns on or off so that the PMOS transistor and the NMOS transistor of the transmission gate can operate correctly.

The detailed circuit diagram and the timing charts of various signals shown in FIGS. 3 and 4 correspond to one example capable of implementing the multiplexer circuit of this invention, and do not intend to limit the invention. Thus, one of ordinary skill in the art may easily modify the technique disclosed herein so that the object of the multiplexer circuit of this embodiment may also be achieved.

In this embodiment, the multiplexer circuit used in this data driver does not need the circuit element capable of withstanding the high voltage, so the size and the cost of the data driver can be reduced.

Second Embodiment

In this embodiment, the architecture of the level shifter 121 of FIG. 1 is improved so that the number of the used circuit elements capable of withstanding the high voltages can be decreased. The level shifter of this embodiment will be described in the following.

Figure 5A:
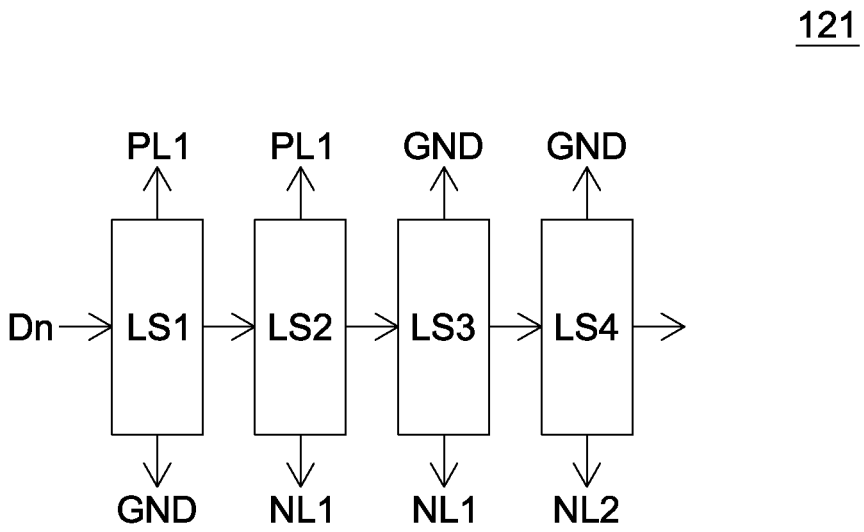
FIG. 5A is a block diagram showing a level shifter 121 according to a second embodiment of the invention.

FIG. 5A is a block diagram showing the level shifter 121 according to a second embodiment of the invention. Referring to FIGS. 1 and 5A, the level shifter 121 includes a number of level shifting units, such as four level shifting units LS1 to LS4. The level shifting unit LS1 receives the second pixel datum Dn corresponding to a voltage level ranging between a ground level GND and a first positive level PL1. The level shifting unit LS2 adjusts the voltage level of the second pixel datum Dn, outputted from the level shifting unit LS1, to a voltage level ranging between a first negative level NL1 and the first positive level PL1. The level shifting unit LS3 adjusts the voltage level of the second pixel datum Dn, outputted from the level shifting unit LS2, to a voltage level ranging between the first negative level NL1 and the ground level GND. The level shifting unit LS4 adjusts the voltage level of the second pixel datum Dn, outputted from the level shifting unit LS3, to a voltage level ranging between a second negative level NL2 and the ground level GND. Then, the digital-to-analog converter 122 of FIG. 1 converts the second pixel datum Dn, outputted from the level shifting unit LS4, into the negative pixel voltage Vn.

In this embodiment, the absolute value of the first negative level NL1 is smaller than the absolute value of the second negative level NL2. Preferably, the absolute value of the first positive level PL1 is substantially equal to the absolute value of the first negative level NL1. The first positive level PL1 is a low voltage level, the first negative level NL1 is another low voltage level, and the second negative level NL2 is a medium voltage level. For example, the first positive level PL1 is substantially equal to 1.8 volts, the first negative level NL1 is substantially equal to −1.8 volts, and the second negative level NL2 is substantially equal to −6 volts.

Using the level shifter 121 of this embodiment can reduce the size of the data driver. The reasons will be stated hereinbelow.

Figure 5B:
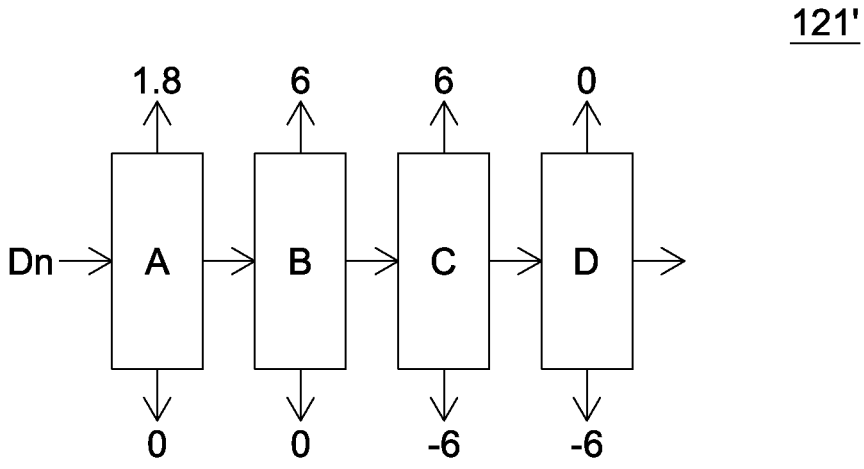
FIG. 5B(PRIOR ART)
FIG. 5B (Prior Art) is a block diagram showing a conventional level shifter.

FIG. 5B (Prior Art) is a block diagram showing a conventional level shifter. As shown in FIG. 5B, because the circuit element capable of withstanding the high voltage has to be used in the data driver using the conventional level shifter 121', the data driver has the larger size. The conventional level shifter 121' includes four level shifting units A to D. In the level shifting unit C, the second pixel datum Dn outputted from the level shifting unit B is adjusted to the level ranging between −6 volts and 6 volts. That is, the difference between the voltage levels to be withstood by the level shifting unit C is equal to 12 volts, which has exceeded the range of the circuit element capable of withstanding the medium voltage (6 volts). So, the circuit element capable of withstanding the high voltage has to be used in the level shifting unit C.

As shown in FIG. 5A, the crossover voltages, which can be withstood by the elements of the four level shifting units LS1 to LS4 in the level shifter 121 of this embodiment, do not exceed 6 volts, so it is unnecessary to use the circuit element capable of withstanding the high voltage. That is, the highest voltage of the crossover voltages withstood by the elements of the level shifting units LS1 and LS3 is equal to 1.8 volts, so the level shifting units LS1 and LS3 may be implemented by circuit elements capable of withstanding the low voltages. Because the highest voltages of the crossover voltages withstood by the elements of the level shifting units LS2 and LS4 are respectively equal to 3.6 volts (−1.8 to 1.8 volts) and 6 volts (−6 to 0 volts), the level shifting units LS2 and LS4 may be implemented by circuit elements capable of withstanding the medium voltages.

The size of one circuit element capable of withstanding the high voltage is larger than sixteen times of the size of the circuit element capable of withstanding the medium voltage. Compared with the conventional level shifter, the circuit element capable of withstanding the high voltage needs not to be used in the level shifter of this embodiment. Thus, the circuit element capable of withstanding the high voltage needs not to be used in the data driver using the level shifter of this embodiment, so the size and the cost of the data driver can be decreased.

Third Embodiment

Figure 6:
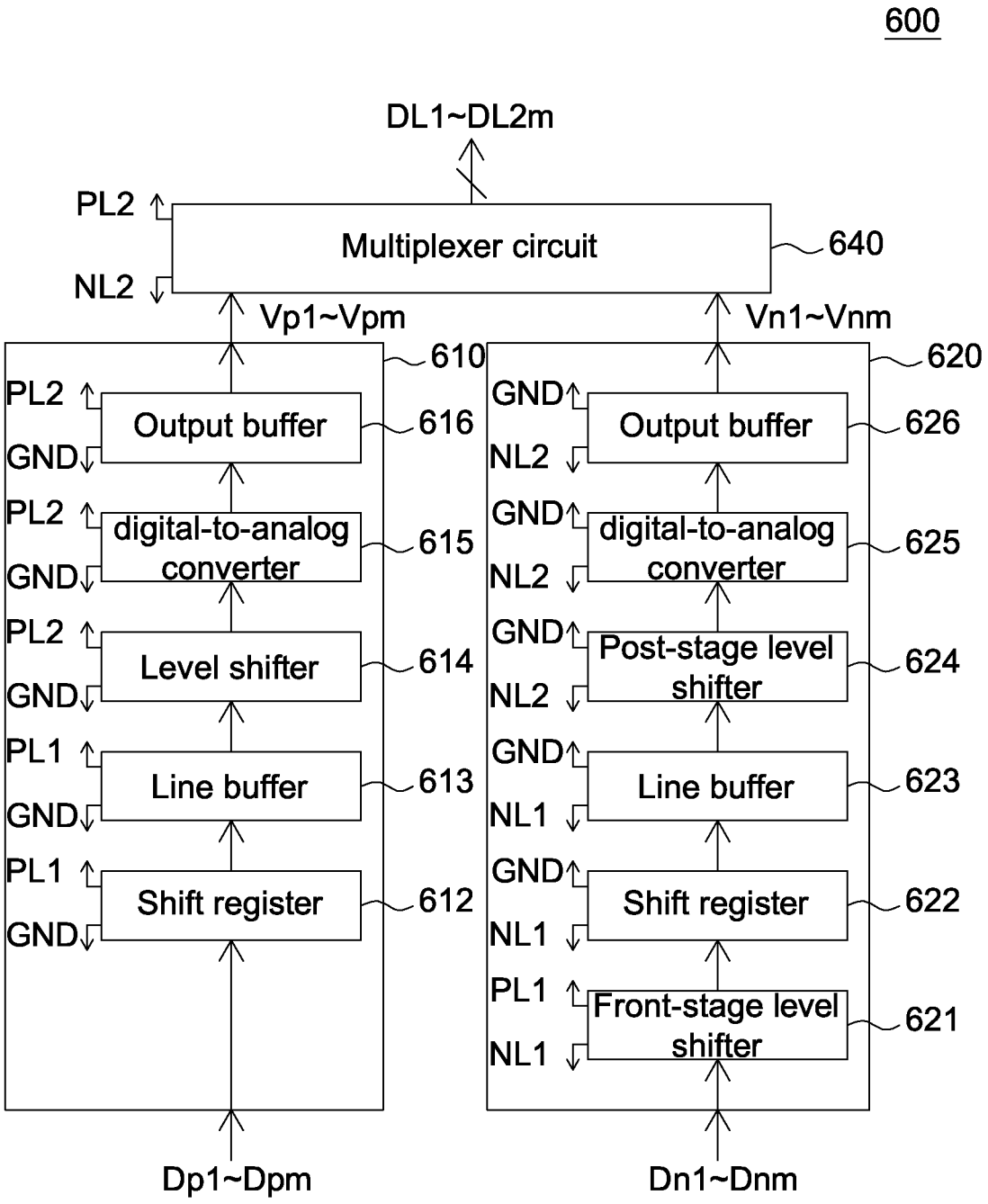
FIG. 6 is a block diagram showing a data driver according to a third embodiment of the invention.

FIG. 6 is a block diagram showing a data driver 600 according to a third embodiment of the invention. As shown in FIG. 6, the data driver 600 correspondingly drives a number of data lines of one display panel according to a number of pixel data. The pixel data include multiple first pixel data Dp1 to Dpm (positive pixel data) and multiple second pixel data Dn1 to Dnm (negative pixel data). The data driver 600 includes a first data processing circuit 610, a second data processing circuit 620 and a multiplexer circuit 640. The first data processing circuit 610 includes a shift register 612, a line buffer 613, a level shifter 614, a digital-to-analog converter 615 and an output buffer 616. The first data processing circuit 610 provides multiple positive pixel voltages Vp1 to Vpm according to the first pixel data Dp1 to Dpm.

The second data processing circuit 620 includes a front-stage level shifter 621, a shift register 622, a line buffer 623, a post-stage level shifter 624, a digital-to-analog converter 625 and an output buffer 626. The elements and operations of the second data processing circuit 620 will be described in the following.

The front-stage level shifter 621 sequentially receives the second pixel data Dn1 to Dnm. For example, the front-stage level shifter 621 receives k set of data each time, wherein k<m. The voltage levels corresponding to the second pixel data Dn1 to Dnm range between the ground level GND and the first positive level PL1. The front-stage level shifter 621 adjusts the voltage levels of the second pixel data Dn1 to Dnm to the voltage levels ranging between the first negative level NL1 and the ground level GND. The front-stage level shifter 621 includes the three level shifting units LS1 to LS3 of FIG. 5A, and the operations thereof will be omitted herein.

The shift register 622 sequentially receives the second pixel data Dn1 to Dnm outputted from the front-stage level shifter 621 and outputs the second pixel data Dn1 to Dnm in parallel. For example, the shift register 622 receives k sets of data each time, and outputs m sets of data together after the m sets of data are received, wherein k<m. The line buffer 623 temporarily stores the second pixel data Dn1 to Dnm outputted from the shift register 622.

The post-stage level shifter 624 adjusts the voltage levels of the second pixel data Dn1 to Dnm, outputted from the line buffer 623, to the voltage level ranging between the second negative level NL2 and the ground level GND. The post-stage level shifter 624 includes the level shifting unit LS4 of FIG. 5A. The digital-to-analog converter 625 converts the second pixel data Dn1 to Dnm, outputted from the post-stage level shifter 624, into multiple negative pixel voltages Vn1 to Vnm. The output buffer 626 temporarily stores the negative pixel voltages Vn1 to Vnm. The multiplexer circuit 640 outputs the positive pixel voltages Vp1 to Vpm and the negative pixel voltages Vn1 to Vnm to the corresponding data lines DL1 to DL2*m*.

In this embodiment, the absolute value of the first negative level NL1 is smaller than the absolute value of the second negative level NL2. Preferably, the absolute value of the first positive level PL1 is substantially equal to the absolute value of the first negative level NL1. The first positive level PL1 is a low voltage level, the first negative level NL1 is another low voltage level, and the second negative level NL2 is a medium voltage level. For example, the first positive level PL1 is substantially equal to 1.8 volts, the first negative level NL1 is substantially equal to −1.8 volts and the second negative level NL2 is substantially equal to −6 volts. Similar to the second embodiment, the highest voltages of the voltages withstood by the elements of the front-stage and post-stage level shifters 621 and 624 are respectively equal to 3.6 volts (−1.8 to 1.8 volts) and 6 volts (−6 to 0 volts). Thus, the level shifter needs not to be implemented using the circuit element capable of withstanding the high voltage.

Compared with the second embodiment, this embodiment can further reduce the size of the data driver according to the reasons stated hereinbelow. It is assumed that the second pixel data Dn1 to Dnm are 512 sets of data (m=512), and each set of the level shifting units LS1 to LS3 can receive 8 sets of data (k=8). In the second embodiment, the level shifting units LS1 to LS3 of FIG. 5A receive the data in parallel, so 64 (512/8=64) sets of level shifting units LS1 to LS3 have to be used in the level shifter 121 to adjust the voltage levels corresponding to 512 sets of second pixel data in parallel.

In this embodiment, one set of level shifting units LS1 to LS3 serves as the front-stage level shifter 621 and is disposed in front of the shift register. The front-stage level shifter 621 sequentially receives 8 sets of data and thus serially adjusts the voltage levels corresponding to 512 sets of second pixel data. Thus, only one set of level shifting units LS1 to LS3 has to be used in this embodiment so that the size of the data driver using the level shifter can be reduced.

In addition, the voltage levels of the second pixel data outputted from the front-stage level shifter 621 range between the first negative level NL1 and the ground level GND in this embodiment. So, the voltage levels used by the circuit elements of the shift register 622 and the line buffer 623 also range between the first negative level NL1 and the ground level GND. In FIG. 6, the voltage levels used by the circuit elements of the shift register 622 and the line buffer 623 range between the first positive level PL1 and the ground level GND. In practice, the absolute values of the first positive level PL1 and the first negative level NL1 are substantially equal to each other. So, the data driver of this embodiment may not increase the power consumption of the system.

In the data driver according to the first embodiment of the invention, the circuit element capable of withstanding the high voltage needs not to be used in the multiplexer circuit, so the number of the circuit elements capable of withstanding the high voltages can be decreased and the size of the multiplexer circuit can be reduced so that the size of the data driver can be reduced. Furthermore, in the second embodiment, the circuit element capable of withstanding the high voltage needs not to be used in the level shift circuit. So, the number of the high-voltage circuit elements also can be decreased and the size of the level shift circuit can be reduced so that the size of the data driver can be reduced. In addition, the level shifter according to the third embodiment of the invention can serially adjust the levels of the data. So, the size and the cost of the data driver can be reduced more effectively without increasing the power consumption of the system.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A data driver for correspondingly driving a plurality of data lines of a display panel according to a plurality of pixel data, the pixel data comprising a first pixel datum and a second pixel datum, the data driver comprising:

a first data processing circuit and a second data processing circuit for processing the pixel data, wherein the first data processing circuit provides a positive pixel voltage according to the first pixel datum, and the second data processing circuit provides a negative pixel voltage according to the second pixel datum; and a multiplexer circuit comprising a plurality of multiplexer units, each of which comprises:

a first input terminal and a second input terminal for respectively receiving the positive pixel voltage and the negative pixel voltage;

an output terminal coupled to one of the data lines;

a first switching device having a first switch, a second switch and a third switch, wherein the first and second switches are serially coupled between the first input terminal and the output terminal, and a voltage level of a first node between the first and second switches is controlled via the third switch; and a second switching device having a fourth switch, a fifth switch and a sixth switch, wherein the fourth and fifth switches are serially coupled between the second input terminal and the output terminal, and a voltage level of a second node between the fourth and fifth switches is controlled via the sixth switch; and a body voltage switching circuit for providing a first body voltage and a second body voltage to each of the first switching device and the second switching device according to a first switching signal;

wherein the first body voltage is simultaneously applied to the first switching device and the second switching device, and the second body voltage is simultaneously applied to the first switching device and the second switching device second body voltage.

2. The data driver according to claim 1, wherein the sixth switch turns on when the first and second switches turn on, and the third switch turns on when the fourth and fifth switches turn on.

3. The data driver according to claim 1, wherein the body voltage switching circuit provides the first and second body voltages to each of the second switch of the first switching device and the fifth switch of the second switching device.

4. The data driver according to claim 3, wherein each of the second switch and fifth switch is controlled by a second switching signal, and the second switching signal is converted into a ground level in a transition interval when the first switching signal is transitioned between a positive voltage level and a negative voltage level.

5. The data driver according to claim 4, wherein the second switching signal is at the positive voltage level and the negative voltage level respectively when the first switching signal is at the negative voltage level and the positive voltage level except in the transition interval.

6. The data driver according to claim 1, wherein the first body voltage is varied between a zero voltage level and a positive voltage level according to the first switching signal, and the second body voltage is varied between a negative voltage level and the zero voltage level according to the first switching signal.

7. The data driver according to claim 6, wherein when the first body voltage is at the zero voltage, the second body voltage is at the negative voltage level, and when the first body voltage is at the positive level, the second body voltage is at the zero voltage level.

8. The data driver according to claim 1, wherein the first and second input terminals of one of the multiplexer units are respectively coupled to the first and second input terminals of another one of the multiplexer units.

9. The data driver according to claim 1, wherein each of the first, second, fourth and fifth switches is a transmission gate (TG).

10. The data driver according to claim 9, wherein each of the transmission gates of the first, second, fourth and fifth switches is capable of withstanding a medium voltage.

11. The data driver according to claim 9, wherein each of the first, second, fourth and fifth switches comprises a PMOS transistor and a NMOS transistor coupled in parallel.

12. The data driver according to claim 11, wherein the body voltage switching circuit provides the first body voltage to a substrate of the PMOS transistor of the second switch and a substrate of the PMOS transistor of the fifth switch, and the second body voltage to a substrate of the NMOS transistor of the second switch and a substrate of the NMOS transistor of the fifth switch.

13. The data driver according to claim 12, wherein each of the second switch and the fifth switch is controlled by a second switching signal, and the second switching signal is coupled to a gate of the NMOS transistor of the second switch and a gate of the PMOS transistor of the fifth switch.

14. The data driver according to claim 13, wherein the second switch signal is converted into a ground level in a transition interval when the first switching signal is transitioned between a positive voltage level and a negative voltage level.

15. The data driver according to claim 1, wherein each of the third and sixth switches is implemented as a transistor.

16. The data driver according to claim 1, wherein a level of the positive pixel voltage ranges between 0V and a positive medium voltage level, and a level of the negative pixel voltage ranges between a negative medium voltage level and 0V.

17. The data driver according to claim 16, wherein the first body voltage is varied between 0V and the positive medium voltage level according to the first switching signal, and the second body voltage is varied between the negative medium voltage level and 0V according to the first switching signal.

18. The data driver according to claim 1, wherein the body voltage switching circuit comprises:

a first inverter coupled between a positive voltage and ground, for providing the first body voltage according to the first switching signal; and a second inverter coupled between a negative voltage and ground, for providing the second body voltage according to the first switching signal.

19. The data driver according to claim 1, wherein the voltage level of the first node between the first and second switches is selectively grounded via the third switch, and the voltage level of the second node between the fourth and fifth switches is selectively grounded via the sixth switch.

20. The data driver according to claim 1, wherein respective levels of the first body voltage and the second body voltage are both varied with a level change of the first switching signal.

21. The data driver according to claim 20, wherein the first switching signal is varied between a first level and a second level, and at each of the first and second levels of the first switching signal, the first body voltage is higher than the second body voltage.

22. A data driver for correspondingly driving a plurality of data lines of a display panel according to a plurality of pixel data, the pixel data comprising a first pixel datum and a second pixel datum, the data driver comprising:

a first data processing circuit and a second data processing circuit for processing the pixel data, wherein the first data processing circuit provides a positive pixel voltage according to the first pixel datum, and the second data processing circuit provides a negative pixel voltage according to the second pixel datum; and a multiplexer circuit comprising a plurality of multiplexer units, each of which comprises:

a first input terminal and a second input terminal for respectively receiving the positive pixel voltage and the negative pixel voltage;

an output terminal coupled to one of the data lines;

a first switching device having a first switch, a second switch and a third switch, wherein the first and second switches are serially coupled between the first input terminal and the output terminal, and a voltage level of a first node between the first and second switches is controlled via the third switch;

a second switching device having a fourth switch, a fifth switch and a sixth switch, wherein the fourth and fifth switches are serially coupled between the second input terminal and the output terminal, and a voltage level of a second node between the fourth and fifth switches is controlled via the sixth switch, wherein each of the second and fifth switches comprises a PMOS transistor and a NMOS transistor coupled in parallel; and a body voltage switching circuit, comprising:

a first inverter coupled between a positive voltage and ground, for providing a first body voltage to the PMOS of the second switch and the PMOS of the fifth switch; and a second inverter coupled between a negative voltage and ground, for providing a second body voltage to the NMOS of the second switch and the NMOS of the fifth switch.

* * * * *